US010260296B2

(12) United States Patent
Riggs et al.

(10) Patent No.: US 10,260,296 B2
(45) Date of Patent: Apr. 16, 2019

(54) CENTRIFUGE TRANSPORTATION APPARATUS

(71) Applicant: White's Equipment Rental, LLC, Woodward, OK (US)

(72) Inventors: Billy R. Riggs, Woodward, OK (US); Christopher L. Kuykendall, Hobbs, NM (US)

(73) Assignee: White's Equipment Rental, LLC, Woodward, OK (US)

( * ) Notice: Subject to any disclaimer, the term of this patent is extended or adjusted under 35 U.S.C. 154(b) by 587 days.

(21) Appl. No.: 14/928,672

(22) Filed: Oct. 30, 2015

(65) Prior Publication Data

US 2017/0120792 A1 May 4, 2017

(51) Int. Cl.

| | |
|---|---|
| ***B66B 7/06*** | (2006.01) |
| ***E21B 21/06*** | (2006.01) |
| ***B66F 3/24*** | (2006.01) |
| ***B66F 11/04*** | (2006.01) |
| ***B66F 7/06*** | (2006.01) |

(52) U.S. Cl.

CPC ..... *E21B 21/065* (2013.01); *B66F 3/24* (2013.01); *B66F 7/0658* (2013.01); *B66F 11/04* (2013.01)

(58) Field of Classification Search

CPC .... B66F 7/065; B66F 3/00; B66F 3/22; B66F 7/22

See application file for complete search history.

(56) References Cited

U.S. PATENT DOCUMENTS

| | | | | |
|---|---|---|---|---|
| 4,088,203 | A * | 5/1978 | Smith, Jr. | B66F 11/042 182/141 |
| 4,447,042 | A * | 5/1984 | Masui | B66F 7/0641 187/204 |
| 8,733,738 | B2 * | 5/2014 | Mun | B23P 21/00 254/122 |
| 9,815,672 | B2 * | 11/2017 | Baudermann | B66F 7/0625 |
| 2010/0243973 | A1 * | 9/2010 | Deuring | B66F 3/22 254/122 |
| 2010/0270523 | A1 * | 10/2010 | Schmitt | B66F 7/0666 254/93 R |

* cited by examiner

*Primary Examiner* — Lee D Wilson

(74) *Attorney, Agent, or Firm* — Hall Estill Law Firm

(57) ABSTRACT

A transportation apparatus is described herein that comprises a lifting apparatus having a support structure, a base portion and a scissor-lift device disposed between the support structure and the base portion. The scissor-lift device having a first arm having a first end and a second end pivotally connected to a second arm having a first end and a second end. The first end of the first arm is hingedly connected to the base portion and the second end of the first arm is slidably engaged with the support structure. Similarly, the first end of the second arm is slidably engaged with the base portion and the second end of the second arm is hingedly connected to the support structure. A method of raising centrifuge equipment to a desired height via the lifting apparatus is also described herein.

20 Claims, 16 Drawing Sheets

CENTRIFUGE TRANSPORTATION APPARATUS

STATEMENT REGARDING FEDERALLY SPONSORED RESEARCH OR DEVELOPMENT

Not applicable.

CROSS-REFERENCE TO RELATED APPLICATIONS

Not applicable.

BACKGROUND OF THE DISCLOSURE

1. Field of the Invention

The present disclosure relates to an apparatus for transporting centrifuges used in various oil and gas operations.

2. Description of the Related Art

Wells for recovering oil, gas and the like are typically created by drilling into an underground source using a hollow drill string supported in a drilling rig. The drill string includes a drill bit at the lower end that is rotated into the ground to create a well bore. As the drill bit is rotated, drilling fluid is pumped down through the interior of the drill string to pass through the bit and return to the surface in the well bore external to the drill string. The drilling fluid acts to lubricate the drill bit and carries the loose solids created by the drill bit to the surface. At the surface, the used drilling fluid is collected and recycled by removing some or all of the solids. The viscosity or solids content of the drilling fluid can be varied depending on the stage of the drilling process and the location of the drill bit below the surface.

Equipment and methods for handling the drilling fluid to remove solids in order to recycle the fluid are well known. Settling tanks, shale shakers, flocculating tanks and centrifuge or cyclone separators can be interconnected to handle the drilling fluids from a drill site and separate the used drilling fluid and undesirable solids for subsequent recycling of the drilling fluid.

Presently, a mud storage tank to hold drilling fluid and a shale shaker to perform screening of larger solids tend to be standard equipment for a drilling rig. In normal well site operation, drilling fluid is circulated out of the borehole and passed over a shale shaker which is a screen to separate large solid particles from the drilling fluid. The shale shaker is generally positioned directly above the mud storage tank. The rest of the equipment for solids handling including a settling tank, a shale bin for collecting solids for disposal, centrifuges and a flocculent tank tends to be available as individual pieces of equipment that must be delivered to the well site in separate loads. It is important to choose compatible equipment that is interconnectable and that is properly sized to be of appropriate capacity to work with other selected equipment. Once delivered to the site, the various pieces of equipment must be assembled together. Generally, a picker truck is needed to lift the centrifuge equipment onto a conventional raised centrifuge stand. It requires superior organization and scheduling skills to ensure the components of a solids handling system are delivered in a timely manner to the work site and assembled into an efficient and reliable solids handling system.

Accordingly, there is a need for an apparatus that is transportable that can lift centrifuge equipment to a necessary height for operation of the centrifuge equipment and lower the centrifuge equipment to a sufficient height that would allow the centrifuge equipment to remain on the transportable apparatus when the centrifuge equipment is transported to another location.

SUMMARY OF THE DISCLOSURE

The disclosure of this application is directed to a transportation apparatus comprising a lifting apparatus having a support structure, a base portion and a scissor-lift device disposed between the support structure and the base portion. The scissor-lift device having a first arm having a first end and a second end pivotally connected to a second arm having a first end and a second end. The first end of the first arm is hingedly connected to the base portion and the second end of the first arm is slidably engaged with the support structure. Similarly, the first end of the second arm is slidably engaged with the base portion and the second end of the second arm is hingedly connected to the support structure. This disclosure is also directed toward a method of raising centrifuge equipment to a desired height via the lifting apparatus described herein.

DETAILED DESCRIPTION OF THE DISCLOSURE

Figure 1:
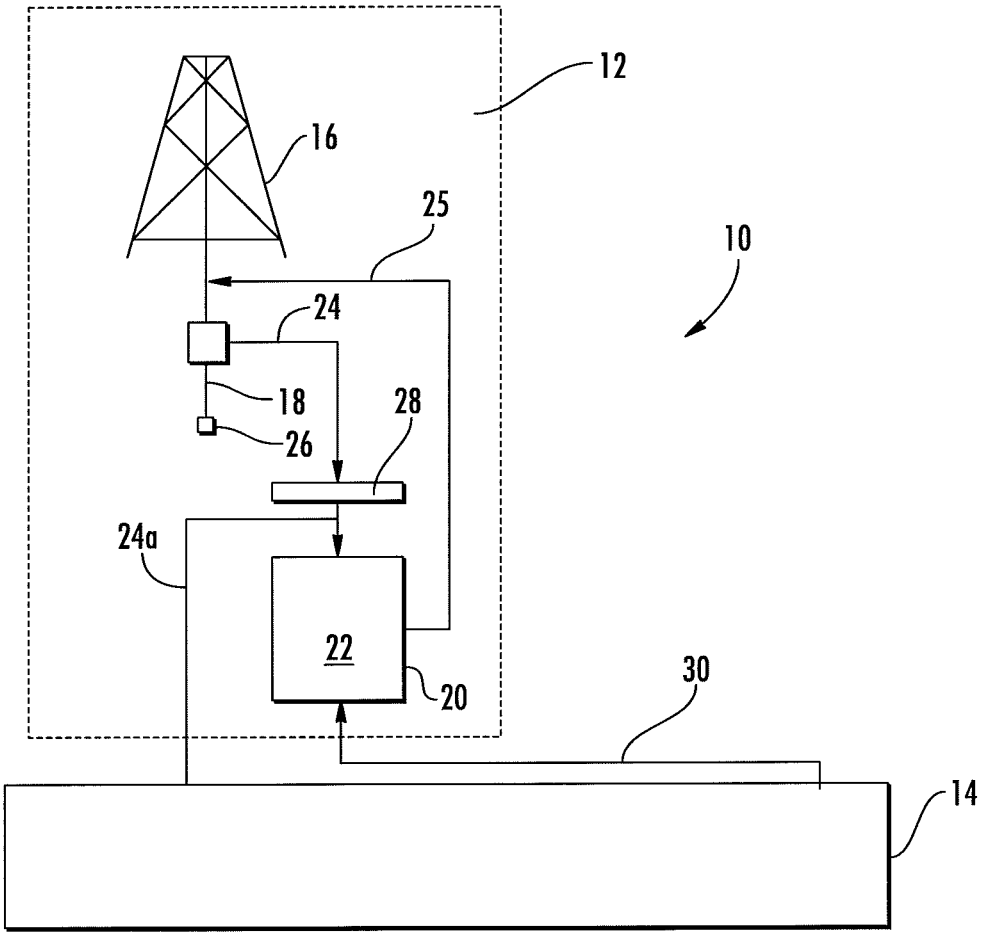
FIG. 1 is a schematic view of a drilling system incorporating a transportable drilling fluid cleaning system constructed in accordance with the present disclosure.

Referring to FIG. 1, there is shown a schematic view of a well drilling system 10 which includes a drill rig 12 and a transportable drilling fluid cleaning system 14 according to the present invention. Drill rig 12 includes a drill derrick 16 supporting a drill string 18 which is rotated to drill a well bore into the ground. A tank 20 associated with drill rig 12 stores drilling fluid 22. The viscosity of drilling fluid 22 can be adjusted depending on the stage to which the well bore is drilled. The apparatus of the present invention can be used to remove undesired solids from the drilling mud and to recycle the drilling fluid to tank 20 at a desired viscosity.

Drilling fluid 22 is pumped in a conventional manner through conduit 25 into drill string 18. Fluid 22 flows downwardly through the drill string to exit from the lower end of the string at bit 26. Drilling fluid 22 acts to lubricate the drill bit 26 and collect cuttings created by the drilling action of the bit 26. The drilling fluid 22 with additional solids flows upwardly in the well bore externally to the drill string 18 to be collected near the surface. The collected drilling fluid/solids mixture passes through conduit 24 to be delivered to shale shaker 28. Shale shaker 28 is a vibrating screen positioned above tank 20 that removes solids from the drilling fluid 22 and delivers cleaned drilling fluid back to tank 20. Depending on the stage of drilling and the volume of drilling fluid being used, shaker 28 may be able to remove solids to an extent such that the drilling fluid simply drains through the shaker directly into tank 20 for re-use. In other cases, some or all of the drilling fluid 22 that passes through shaker 28 is diverted via conduit 24*a* for delivery to the drilling fluid cleaning apparatus 14 of the present disclosure. Apparatus 14 removes solids from the drilling fluid 22 by settling, centrifuging or a combination of methods to deliver cleaned drilling fluid back to tank 20 via conduit 30.

Figure 2:
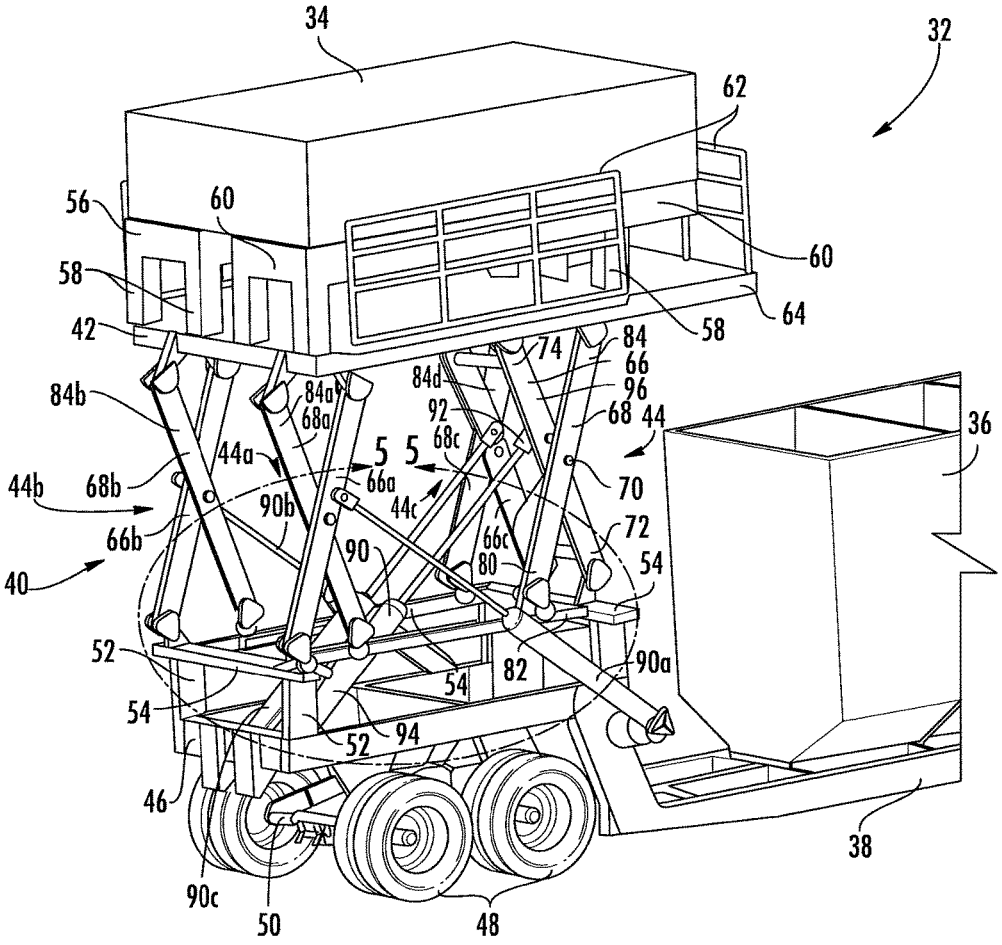
FIG. 2 is a perspective view of a lifting apparatus in an operational position and constructed in accordance with the present disclosure.

Referring now to FIG. 2, shown therein is a transportable support apparatus 32 used to support various components of the drill fluid cleaning system 14. The drill fluid cleaning system 14 can include any type of equipment known in the art for processing, cleaning, and/or treating drilling fluid. For purposes of this disclosure the drill fluid cleaning system 14 is only shown with centrifuge equipment 34 and a settling tank 36. The centrifuge equipment 34 can be any equipment known in the art for use with a centrifuge process for oil and gas operations. The settling tank 36 can be supported by a platform 38 of the transportable support apparatus 32. The centrifuge equipment 34 can be supported by a lifting apparatus 40.

The lifting apparatus 40 can be disposed on the transportable support apparatus 32 in any location such that the centrifuge equipment 34 is positioned in an appropriate location/height when the lifting apparatus 40 is in an operational (or extended) position (shown in FIG. 2) such that the centrifuge operation can be properly conducted. The location of the lifting apparatus 40 on the transportable support apparatus 32 also has to allow the centrifuge equipment 34 to be lowered to a sufficient height when the lifting apparatus 40 is in a transport (or retracted) position (shown in FIG. 3). The height of the centrifuge equipment 34 in the transport position has to be positioned low enough that the centrifuge equipment 34 can safely pass under various height restrictions on roads and highways, such as the clearance heights of bridges and overpasses.

The lifting apparatus 40 includes a support structure 42 for supporting the centrifuge equipment 34, at least one scissor-lift device 44 supporting the support structure 42 on one end of the scissor-lift device 44 to raise and lower the support structure 42 and a base portion 46 supporting the at least one scissor-lift device 44 on the other side from the support structure 42. The base portion 46 can be can be supported by or attached to the platform 38 of the transportable support apparatus 32. The base portion 46 can also be supported above wheels 48 and/or axles 50 that are incorporated into the transportable support apparatus 32. The base portion 46 can include any number of vertical supports 52 and lateral supports 54 so that the centrifuge equipment 34, the scissor-lift devices 44 and the support structure 42 are properly supported.

The support structure 42 for the centrifuge equipment 34 can include a centrifuge platform 56 for supporting various components of the centrifuge equipment 34. The centrifuge platform 56 can include vertical supports 58 and lateral supports 60, which can be designed in any manner such that various components of the centrifuge equipment 34 are appropriately supported. The support structure 42 can also include railing guards 62 disposed around an edge portion 64 of the centrifuge platform 56.

The scissor-lift device 44 includes a first arm 66 and a second arm 68 pivotally interconnected at a pivot point 70 in a scissors-like fashion and movable relative to one another between expanded and retracted conditions so as to move the support structure 42 between raised and lowered positions relative to the base portion 46. The arms 66 and 68 may have a solid or hollow tubular construction and they may have a substantially rectangular, circular, triangular or oval cross-section. Though the arms 66 and 68 may have any other suitable configuration. In one embodiment, the length of each arm 66, 68 is equal to or smaller than the respective length of the centrifuge platform 56.

Figure 4:
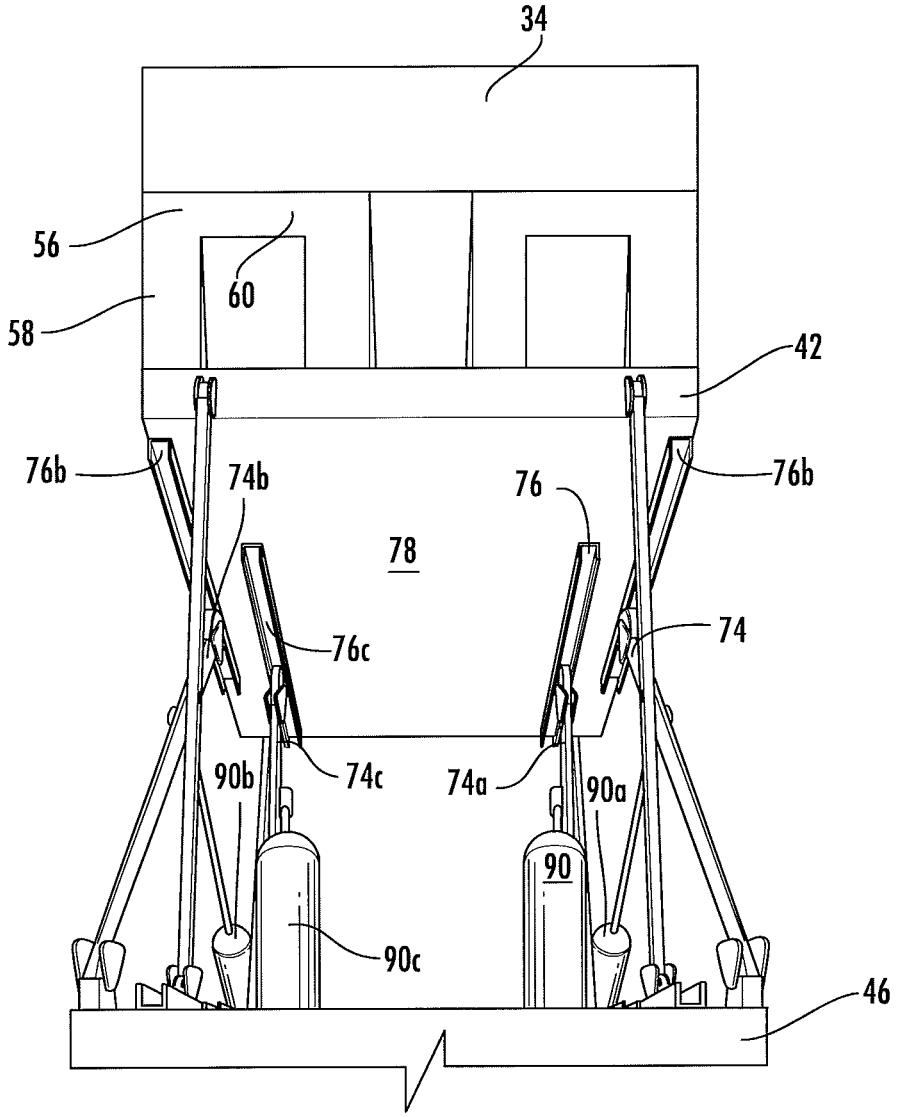
FIG. 4 is a perspective view of a portion of the lifting apparatus constructed in accordance with the present disclosure.
Figure 5:
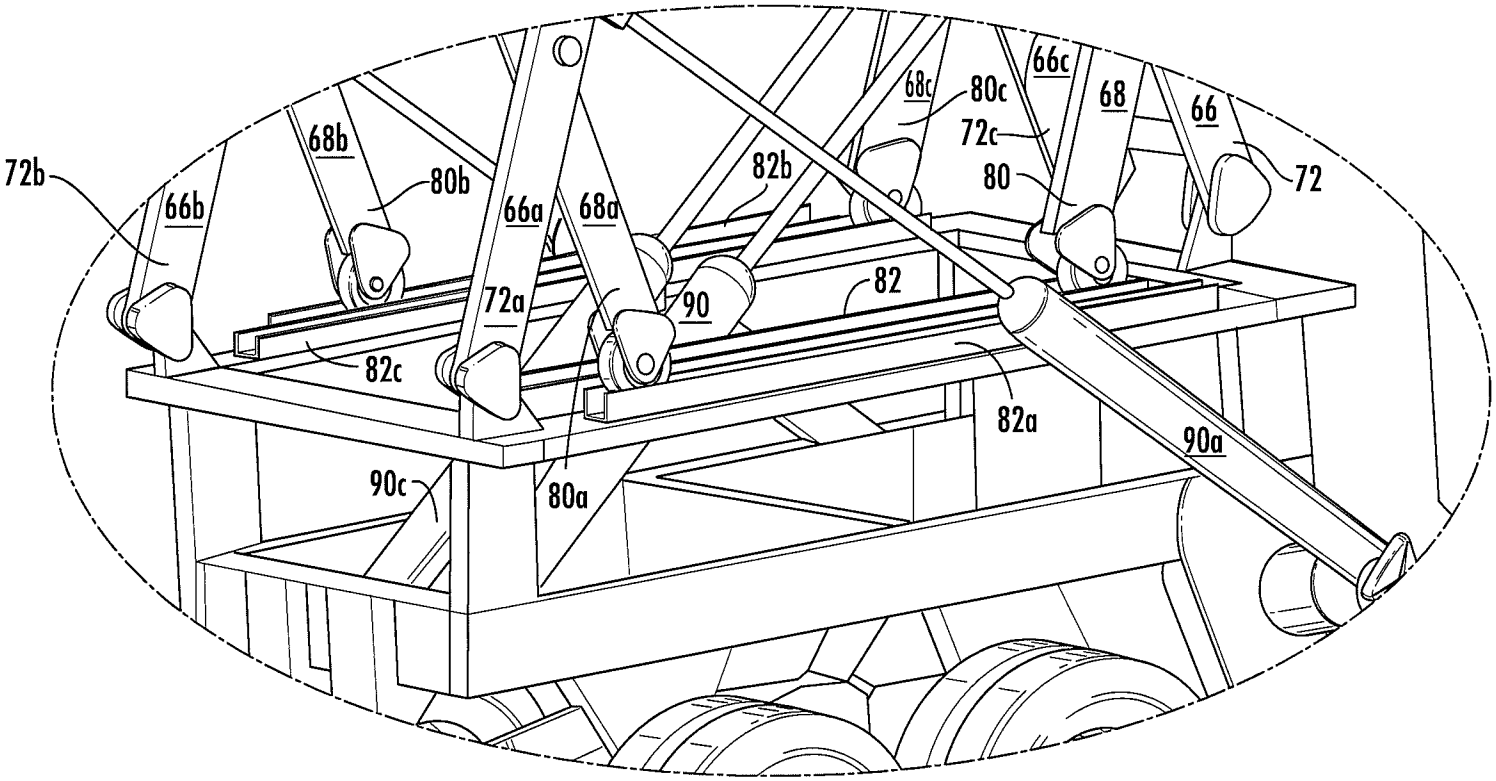
FIG. 5 is a perspective view of another portion of the lifting apparatus constructed in accordance with the present disclosure.

The first arm 66 of the scissor-lift device 44 has a first end 72 that is hingedly connected to the base portion 46 of the lifting apparatus 40 and a second end 74 slidably engagable with an upper guiding element 76 (see FIG. 4) disposed on an underside portion 78 of the support structure 42. Conversely, the second arm 68 of the scissor-lift device 44 has a first end 80 slidably engaged with a lower guiding element 82 (see FIG. 5) disposed on the base portion 42 and a second end 84 hingedly connected to the support structure 42. The lifting apparatus 40 can have any number of scissor lift devices 44 such that the support structure 42 can be safely lifted to the desired height.

In one embodiment, the lifting apparatus 40 can include four (4) scissor lift devices 44 that all operate as already described herein. In this embodiment, there would be additional scissor lift devices 44*a*, 44*b* and 44*c* having first arms 66*a*, 66*b* and 66*c* and second arms 68*a*, 68*b*, and 68*c*. Each first arm 66*a*, 66*b* and 66*c* would have a first end 72*a*, 72*b* and 72*c* that is hingedly connected to the base portion 46 of the lifting apparatus 40 and a second end 74*a*, 74*b* and 74*c* slidably engagable with upper guiding elements 76*a*, 76*b* and 76*c* disposed on the underside portion 78 of the support structure. Similar to what has been previously described, each second arm 68*a*, 68*b* and 68*c* of the scissor-lift devices 44*a*, 44*b* and 44*c* would have first ends 80*a*, 80*b* and 80*c* slidably engaged with lower guiding element 82*a*, 82*b* and 82*c* disposed on the base portion 42 and second ends 84*a*, 84*b* and 84*c* hingedly connected to the support structure 42.

Figure 6:
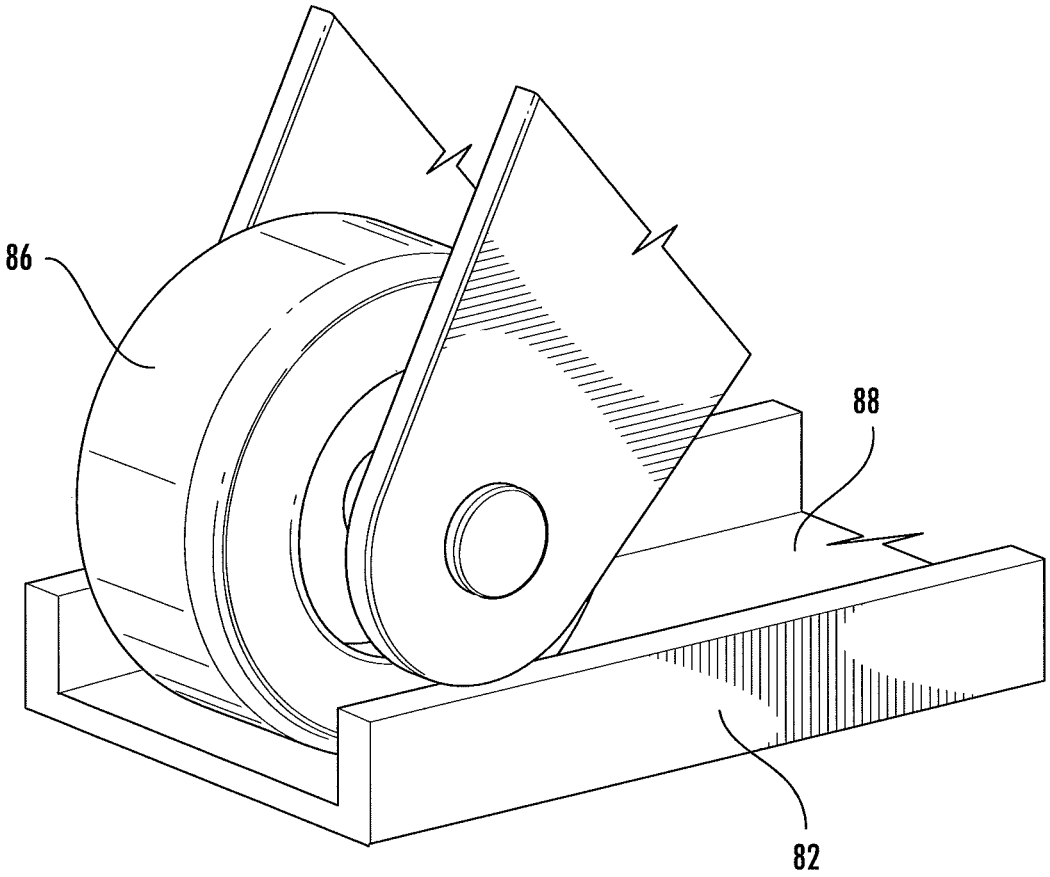
FIG. 6 is a perspective view of yet another portion of the lifting apparatus constructed in accordance with the present disclosure.
Figure 7:
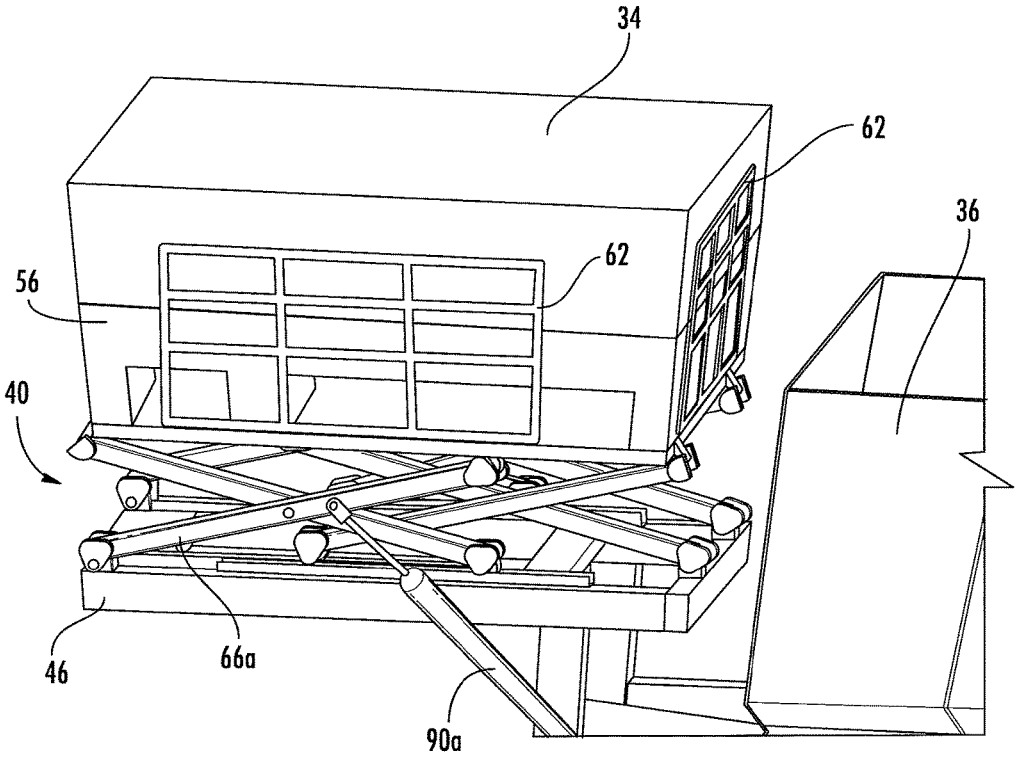
FIGS. 7-10 are perspective views of the lifting apparatus at varying stages of height and constructed in accordance with the present disclosure.
Figure 8:
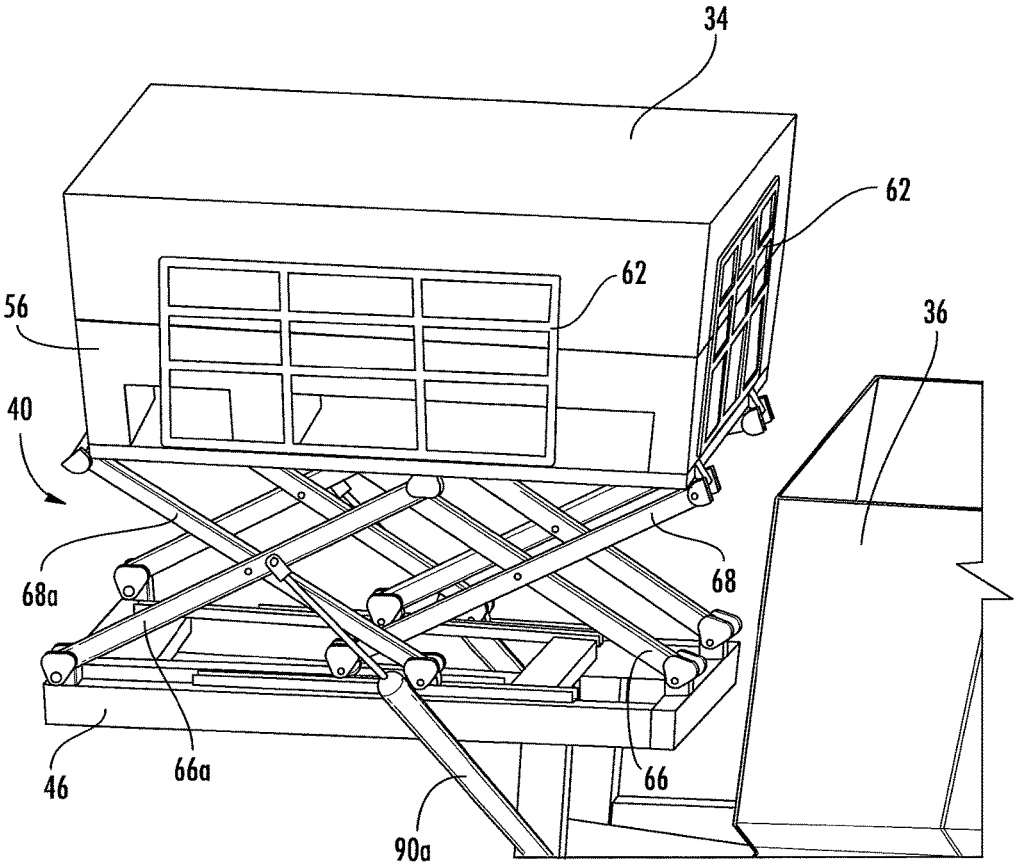
Figure 9:
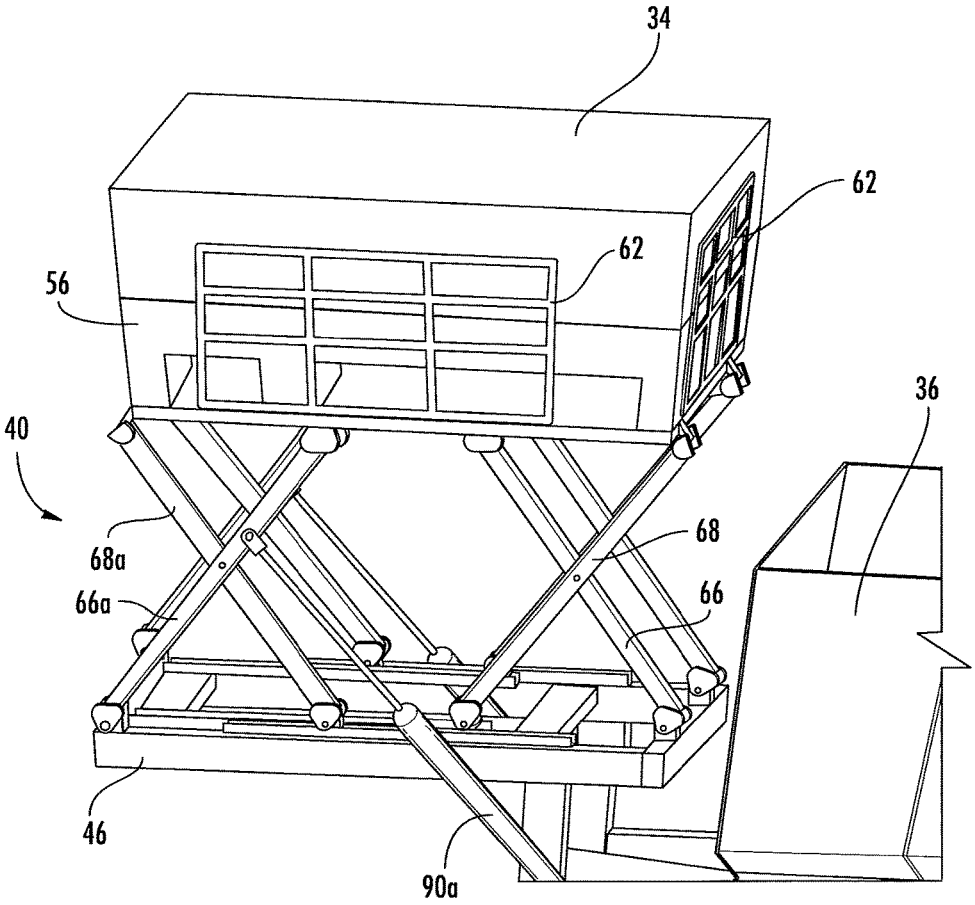
Figure 10:
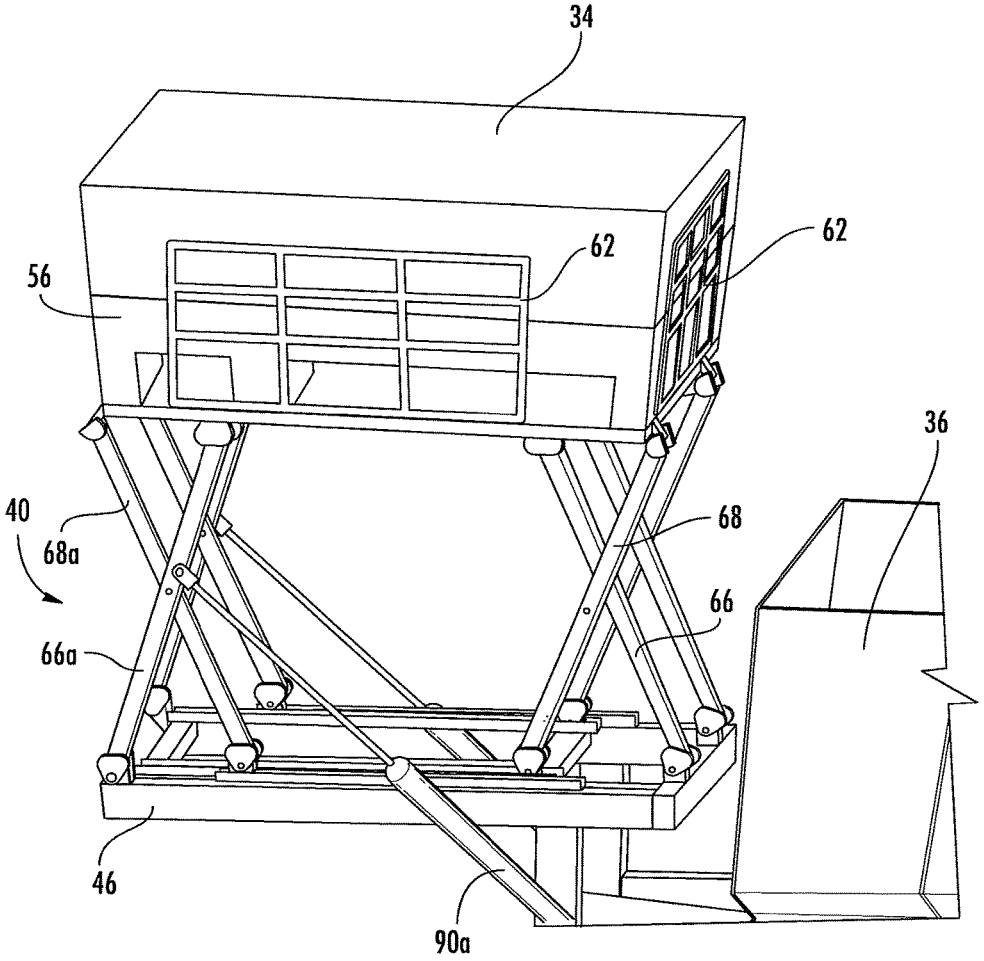
Figure 11:
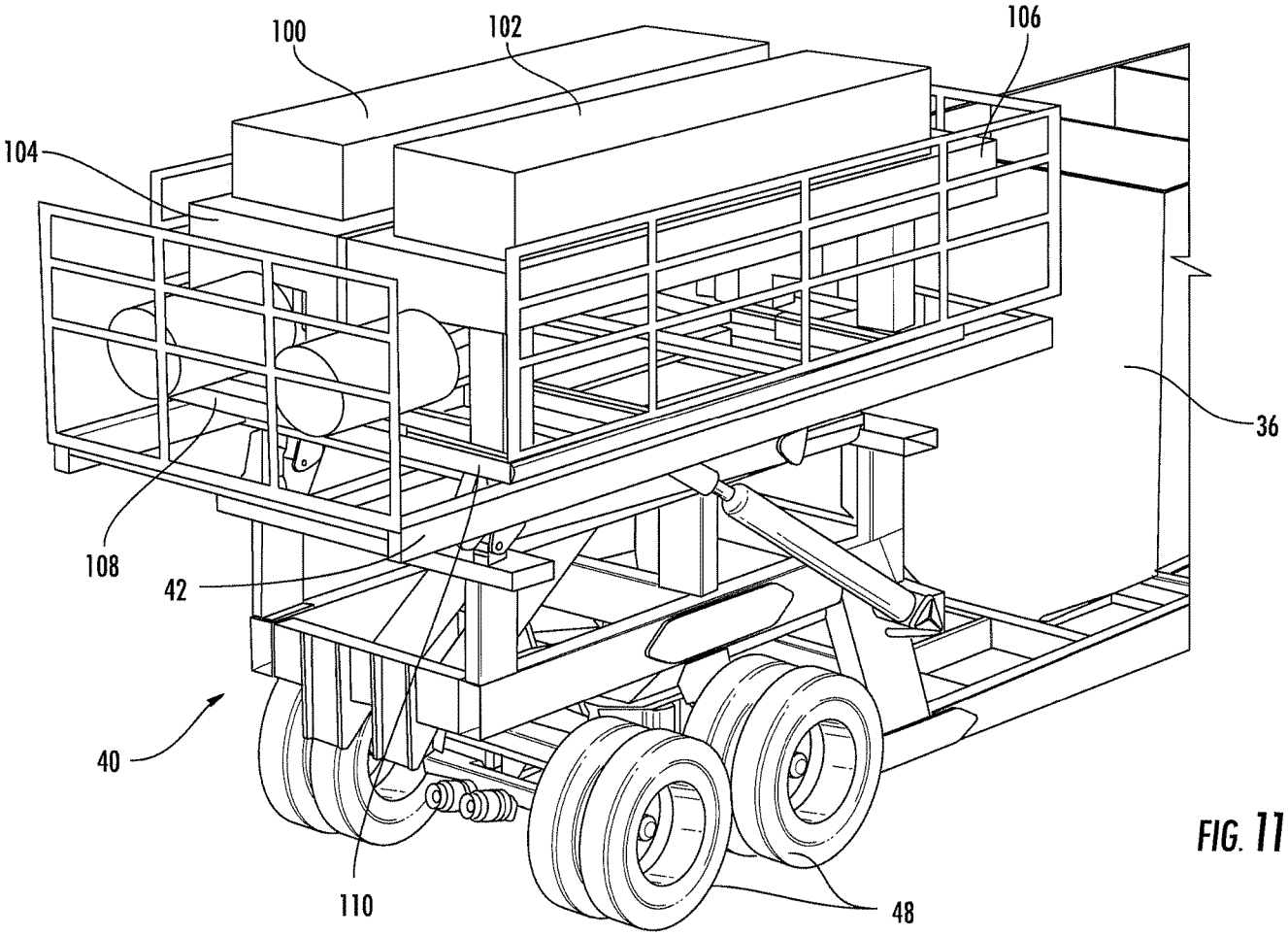
FIG. 11 is a perspective view of another embodiment of the lifting apparatus in the transport position and constructed in accordance with the present disclosure.
Figure 12:
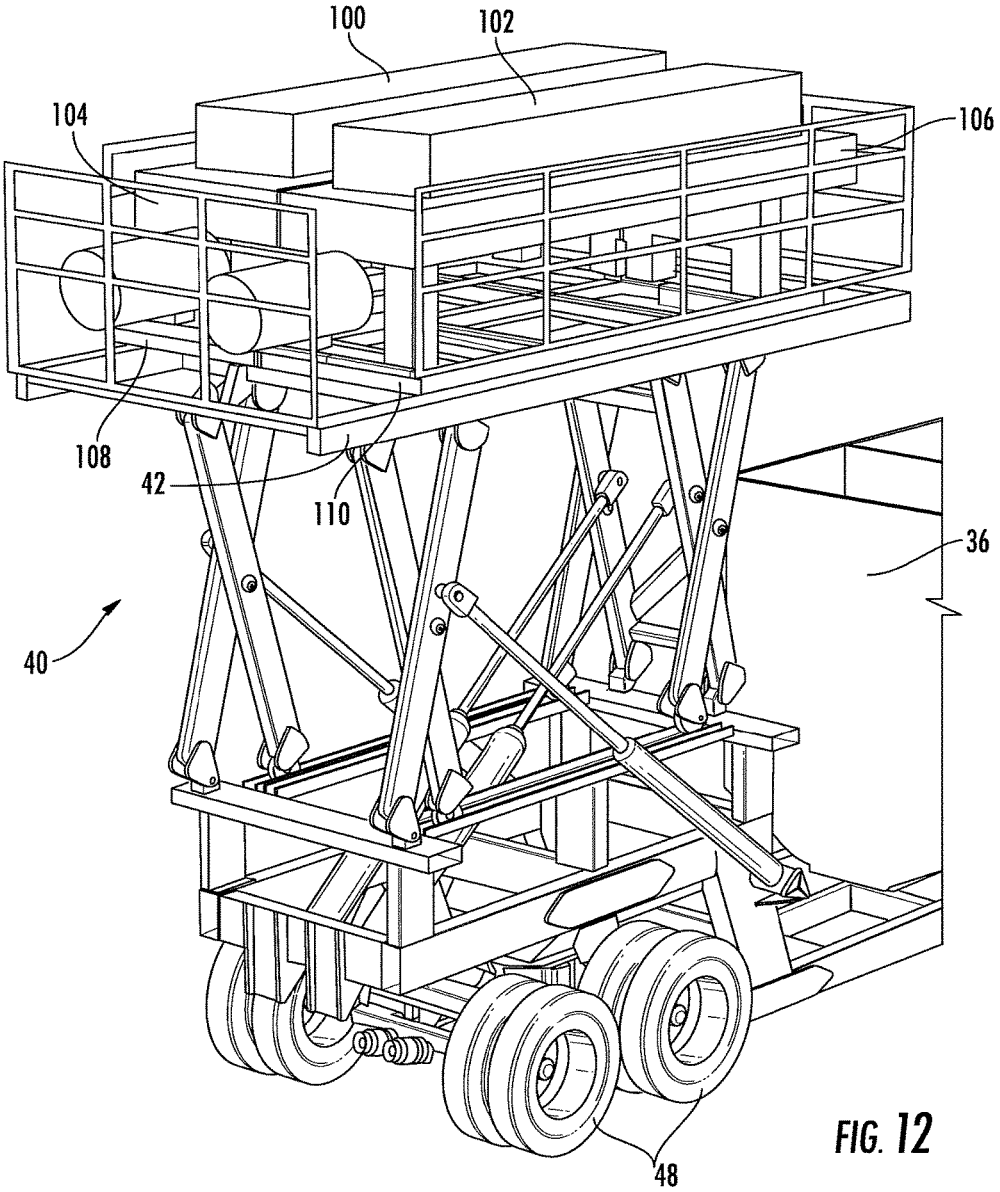
FIGS. 12-14 are perspective views of the embodiment shown in FIG. 11 showing the lifting apparatus in various other positions and constructed in accordance with the present disclosure.
Figure 13:
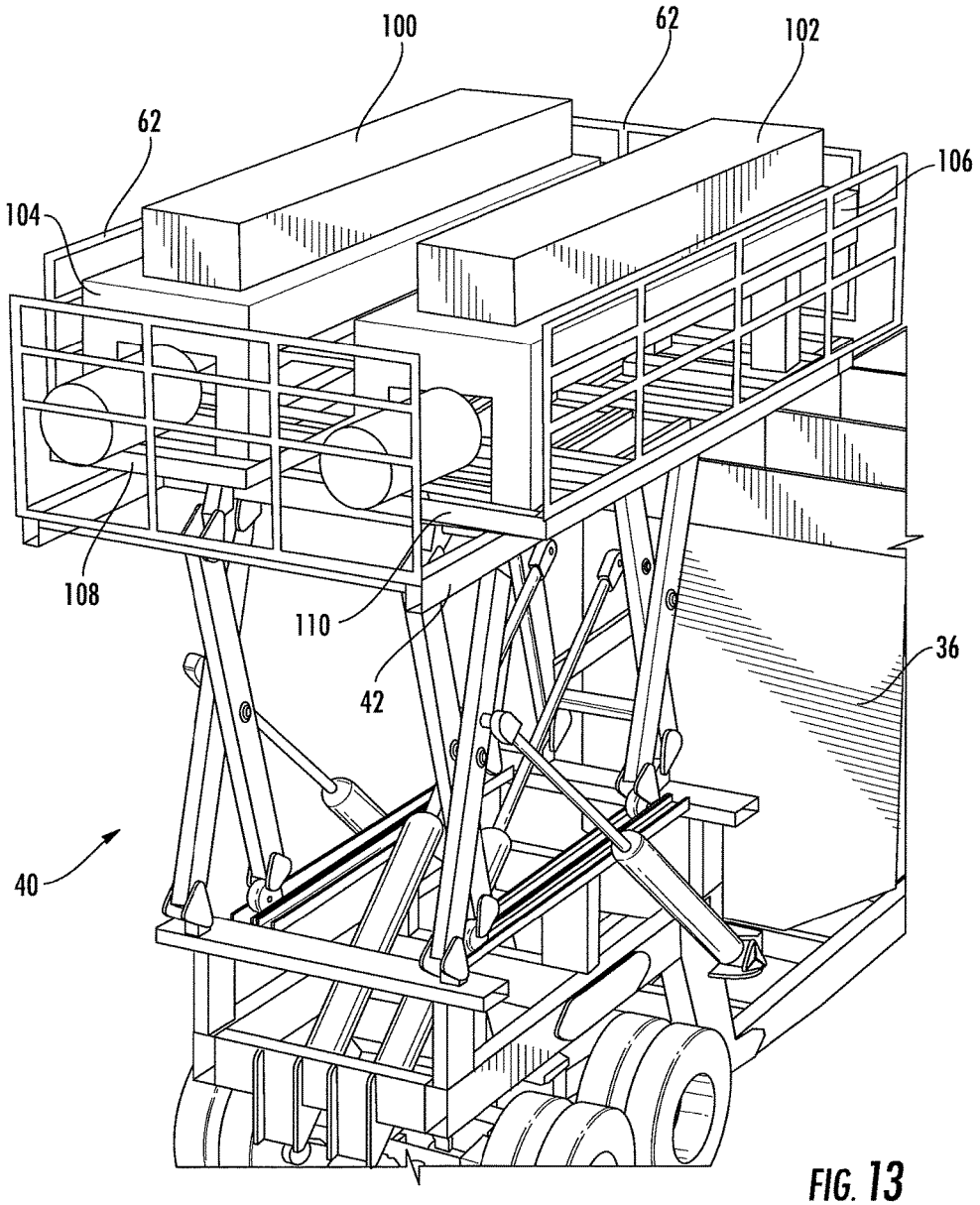
Figure 14:
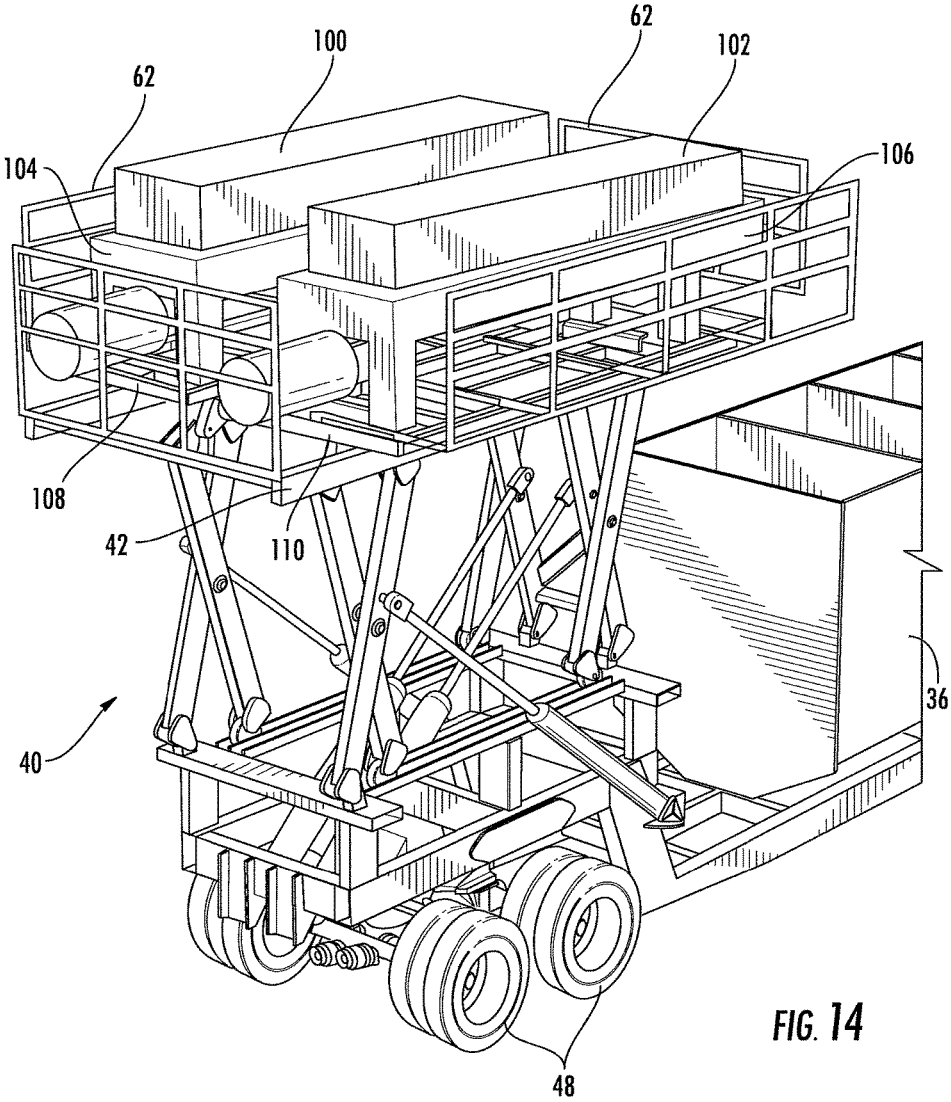

The sliding engagement between the second ends 74, 74*a*, 74*b*, 74*c* of the first arms 66, 66*a*, 66*b*, 66*c* and the upper guiding elements 76, 76*a*, 76*b*, 76*c* and the sliding engagement between the first ends 80, 80*a*, 80*b*, 80*c* of the second arms 68, 68*a*, 68*b*, 68*c* and the lower guiding elements 82, 82*a*, 82*b*, 82*c* can be any type known in the art. In one embodiment, the second ends 74, 74*a*, 74*b*, 74*c* of the first arms 66, 66*a*, 66*b*, 66*c* and the first ends 80, 80*a*, 80*b*, 80*c* of the second arms 68, 68*a*, 68*b*, 68*c* can include a wheel element 86 (see FIG. 6) to engage the upper guiding elements 76, 76*a*, 76*b*, 76*c* and the lower guiding elements 82, 82*a*, 82*b*, 82*c*. In a further embodiment, the wheel element 86 would include a channel 88 to accept the upper guiding elements 76, 76*a*, 76*b*, 76*c* and the lower guiding elements 82, 82*a*, 82*b*, 82*c*. In another embodiment, the second ends 74, 74*a*, 74*b*, 74*c* of the first arms 66, 66*a*, 66*b*,

66*c* and the first ends 80, 80*a*, 80*b*, 80*c* of the second arms 68, 68*a*, 68*b*, 68*c* directly engage and slide against the upper guiding elements 76, 76*a*, 76*b*, 76*c* and the lower guiding elements 82, 82*a*, 82*b*, 82*c*. In another embodiment, the upper guiding elements 76, 76*a*, 76*b*, 76*c* and the lower guiding elements 82, 82*a*, 82*b*, 82*c* could be provided with a groove to accept the wheel element 86.

The lifting apparatus 40 also includes at least one extension device 90 that is rotatably attachable to one of the first arms 66 or one of the second arms 68 on a first end 92 and rotatably attachable to the base portion 46 on the second end 94 of the extension device 90. When the extension device 90 is in a retracted position, the lifting apparatus 40 is in the transport position and when the extension device 90 is in the extended position, the lifting apparatus 40 is in the operational position. In a more specific embodiment, the first end 94 of the extension device 90 is attached to an upper half portion 96 of the first arm 66 or second arm 68 of the scissor-lift device 44. In one embodiment, the extension device 90 is a hydraulic cylinder. It should be understood and appreciated that the extension device 90 can be any type of device known in the art capable of forcing the scissor lift devices 44, 44*a*, 44*b* and 44*c* to actuate and lift the support structure 42 into the operational position. In a further embodiment of the present disclosure, each scissor-lift device 44, 44*a*, 44*b* and 44*c* would have a corresponding extension device 90, 90*a*, 90*b*, and 90*c*.

It is contemplated that a retraction device could be implemented such that when the lifting apparatus 40 was in the operational position, the retraction device would be in a retracted position and when the lifting apparatus was in the transport position, the retraction device would be in an extended position.

Figure 3:
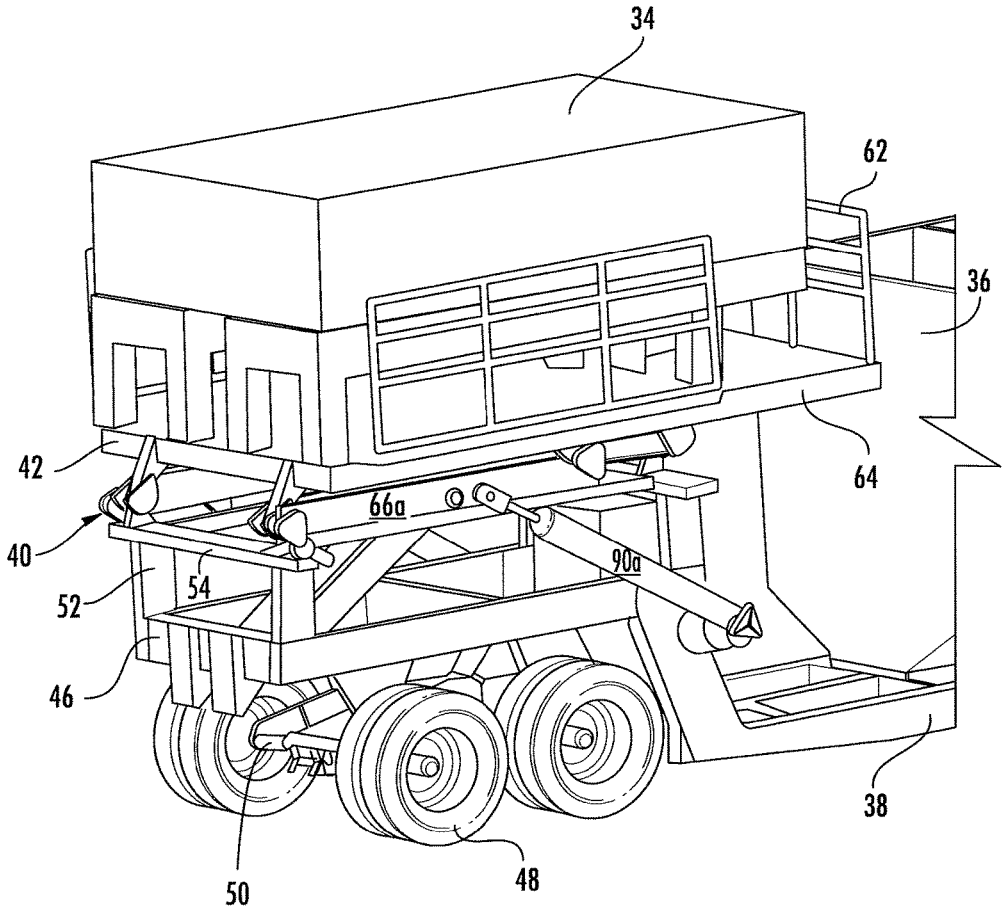
FIG. 3 is a perspective view of the lifting apparatus in a transport position and constructed in accordance with the present disclosure.

As previously disclosed herein FIG. 2 shows the lifting apparatus 40 fully extended in the operational position and FIG. 3 shows the lifting apparatus 40 in the fully retracted transport position. FIGS. 7-10 show the lifting apparatus 40 in various stages as the lifting apparatus 40 moves from the transport position to the operational position.

In another embodiment of the present disclosure shown in FIGS. 11-16, the centrifuge equipment 34 of the transportable support apparatus 32 can be provided as a first centrifuge element 100 and a second centrifuge element 102 that require separation there between so users of the centrifuge equipment 34 can access centrifuge elements 100 and 102. To accommodate the first centrifuge element 100 and the second centrifuge element 102, the transportable support apparatus 32 includes a first centrifuge platform 104 to support the first centrifuge element 100 and a second centrifuge platform 106 and a second centrifuge platform 106 to support the second centrifuge element 102.

Furthermore, in this embodiment, the transportable support apparatus 32 further includes a first shiftable platform 108 shiftably or slidably disposed relative to, and above, the support structure 42 and a second shiftable platform 110 shiftably or slidably disposed relative to, and above, the support structure 42. The first shiftable platform 108 is included in the transportable support apparatus 32 to support the first centrifuge platform 104 and the second shiftable platform 110 to support the second centrifuge platform 106. When the transportable support apparatus 32 is in the transport position, the first and second shiftable platforms 108 and 110 are positioned directly adjacent to each other to facilitate safe travel. When the transportable support apparatus 32 is in the operational position, the first and second shiftable platforms 108 and 110 are slid or shifted away from each other a certain distance to allow users enough room to access the first centrifuge element 100 and a second centrifuge element 102.

The first and second shiftable platforms 108 and 110 can be slid or shifted from each other by any manner known in the art. In one embodiment, a hydraulic cylinder can be used to drive a cable and pulley system that shifts or slides the first and second shiftable platforms 108 and 110 apart and back together. The same apparatus or device used to slide or shift the first and second shiftable platforms 108 and 110 apart can also be used shift of slide the first and second shiftable platforms 108 and 110 back together or adjacent to each other. In another embodiment, the first and second shiftable platforms 108 and 110 can be shifted or slid back together or adjacent to each other with a completely separate device or apparatus than the one that shifts or slides them apart.

In a further embodiment of the present disclosure, the railing guards 62 can also be extended from the first and second shiftable platforms 108 and 110 to allow a user to access the centrifuge elements 100 and 102.

Figure 15:
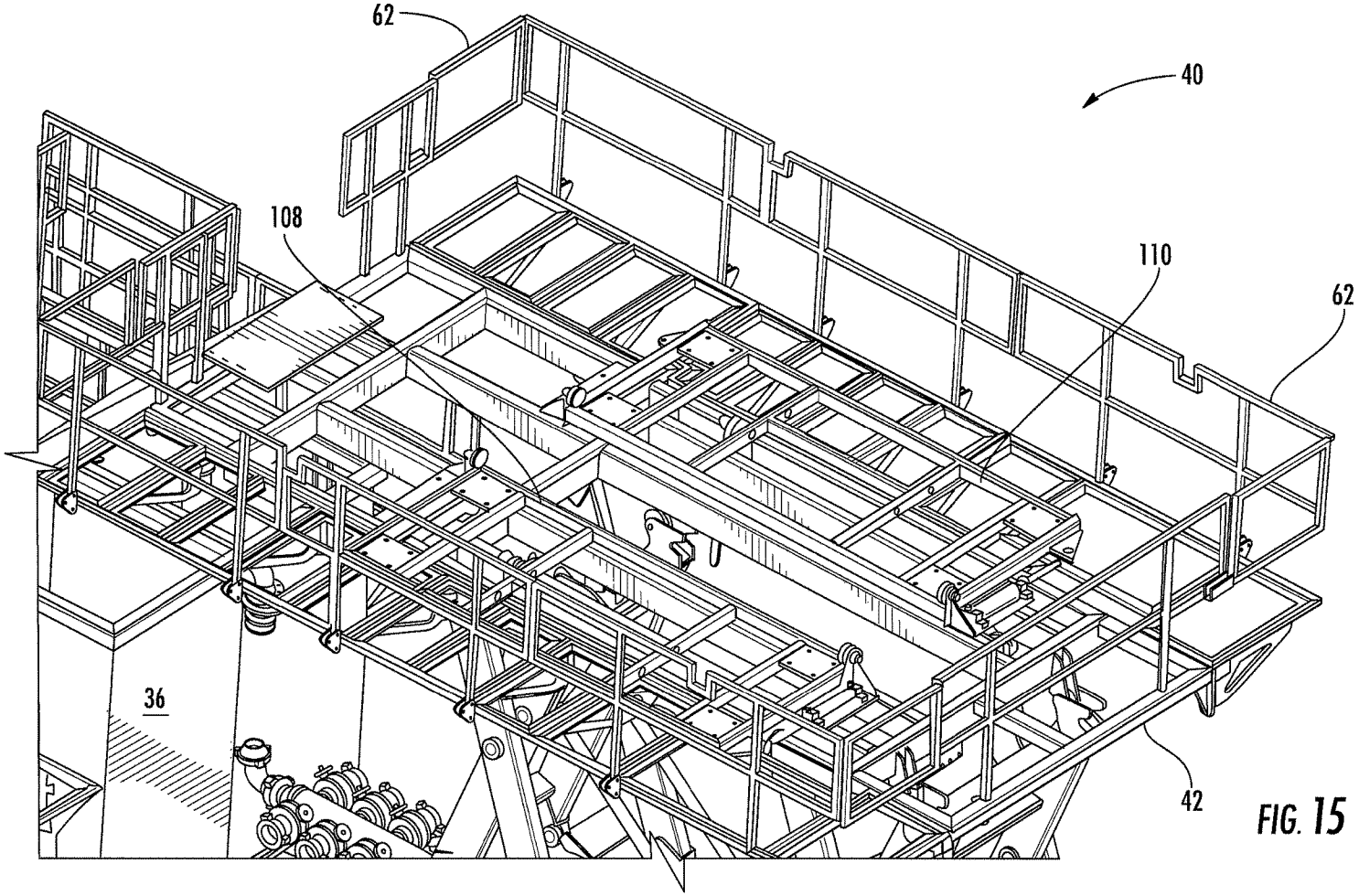
FIG. 15 is a perspective view of a portion of the lifting apparatus shown in FIGS. 11-14.
Figure 16:
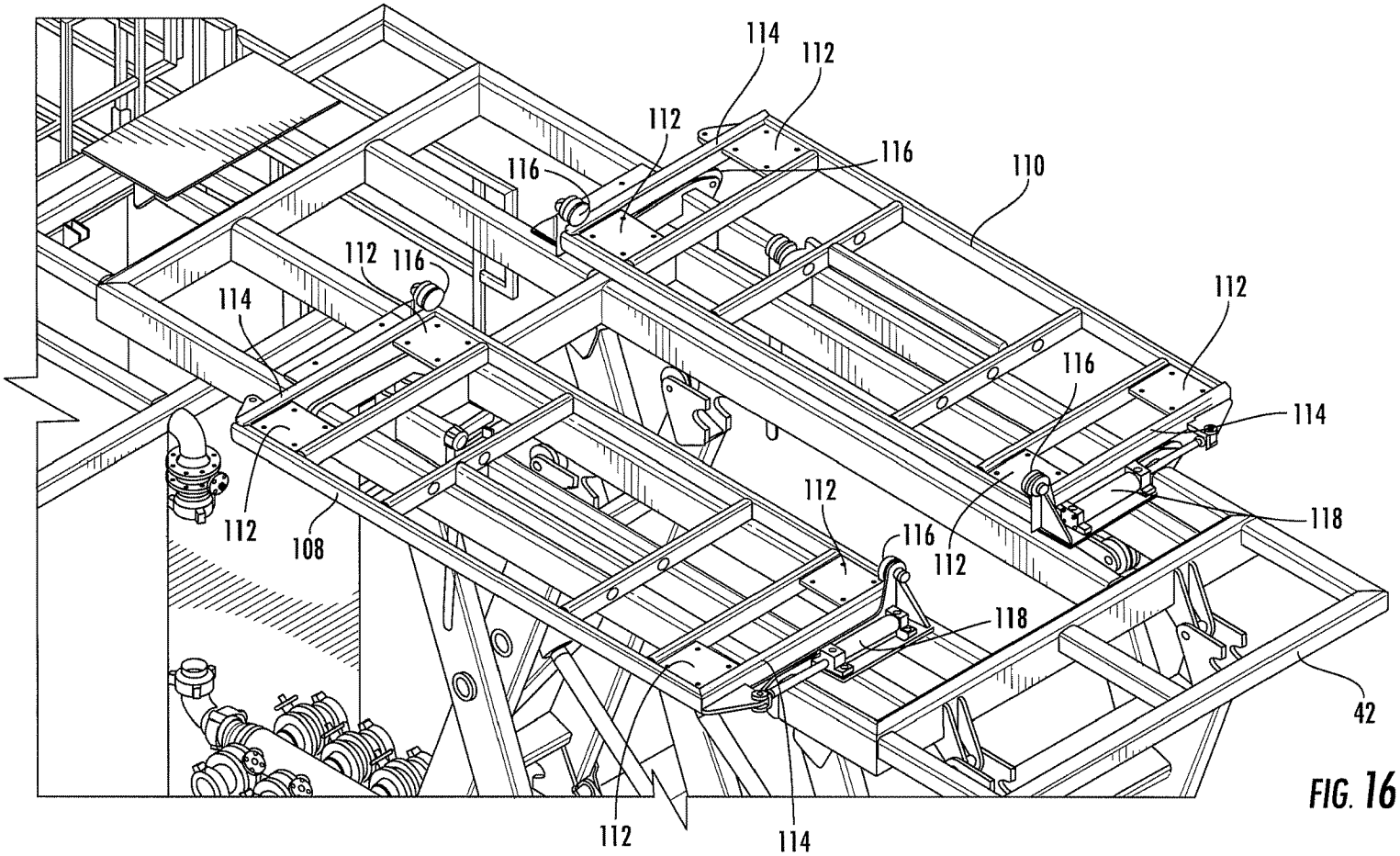
FIG. 16 is a perspective view of another portion of the lifting apparatus shown in FIGS. 11-14.

Shown in more detail in FIGS. 15 and 16, each shiftable platform 108, 110 includes at least one centrifuge support plate 112 for supporting the vertical supports 58 of the centrifuge platform 56 and guide rails 114 disposed on the support structure 42 to engage rollers 116 that are supported by the support structure 42 of the transportable support apparatus 32 for the centrifuge equipment 34. The support structure 42 can also include additional rollers 116 supported thereon to engage an underside portion of each shiftable platform 108,110 to facilitate the shifting/sliding of the shiftable platforms 108, 110. It should be understood and appreciated that the rollers 116 can be designed similarly to the wheel elements 86 previously disclosed herein.

The lifting apparatus 40 also includes at least one platform driving apparatus 118 to force the shiftable platforms 108 and 110 in the operational position and back into the transportable position. Each platform driving apparatus 118 is supported on one end to the support structure 42 and attached to a part of the first or second shiftable platform 110 or 112. In one embodiment, the platform driving apparatus 118 can be a hydraulic piston, but it should be understood and appreciated that any device known in the art capable of expanding or extracting the shiftable platforms 108 and/or 110 can be implemented.

From the above description, it is clear that the present disclosure is well adapted to carry out the objectives and to attain the advantages mentioned herein as well as those inherent in the disclosure. While presently preferred embodiments have been described herein, it will be understood that numerous changes may be made which will readily suggest themselves to those skilled in the art and which are accomplished within the spirit of the disclosure and claims.

What is claimed is:

1. A transportable support apparatus, the apparatus comprising:

a lifting apparatus for raising and lowering centrifuge equipment, the lifting apparatus having a support structure, a base portion and a scissor-lift device disposed between the support structure and the base portion, the scissor-lift device comprising:

a first arm having a first end and a second end pivotally connected to a second arm having a first end and a second end, the first end of the first arm hingedly connected to the base portion and the second end of the first arm slidably engaged with the support structure, the first end of the second arm slidably engaged with the base portion and the second end of the second arm hingedly connected to the support structure; and wherein the first arm and the second arm are offset from each other to engage with guiding elements disposed on the support structure and the base portion.

2. The apparatus of claim 1 wherein the guiding element of the support structure is disposed on an underside portion thereof to engage with the second end of the first arm and the guiding element of the base portion is disposed thereon to engage with the first end of the second arm.

3. The apparatus of claim 2 wherein the second end of the first arm and the first end of the second arm include a wheel element to facilitate improved sliding engagement with the guiding element on the underside portion of the support structure and the guiding element disposed on the base portion.

4. The apparatus of claim 1 wherein the lifting apparatus further includes an extension device to force one end of the first or second arm upwards to raise the support structure away from the base portion.

5. The apparatus of claim 4 wherein the extension device is a hydraulic cylinder.

6. The apparatus of claim 4 wherein the lifting apparatus includes four scissor-lift devices and four extension devices.

7. The apparatus of claim 2 wherein the support structure includes four separate guiding elements disposed on the underside portion of the support structure and the base portion includes four separate guiding elements disposed thereon.

8. The apparatus of claim 4 wherein the extension device has a first end rotatably attached to the first or second arm of the scissor-lift device and a second end rotatably attached to the base portion.

9. The apparatus of claim 1 wherein the lifting apparatus includes a first centrifuge platform slidably disposed relative to the support structure for supporting a first centrifuge element and a second centrifuge platform slidably disposed relative to the support structure for supporting a second centrifuge element.

10. The apparatus of claim 9 wherein the support structure of the lifting apparatus includes rollers to engage with the first and second centrifuge platforms to facilitate the sliding of the first and second centrifuge platforms away from each other in an operational position and adjacent to one another when in a transportable position.

11. A transportable support apparatus, the apparatus comprising:

a lifting apparatus for raising and lowering centrifuge equipment, the lifting apparatus having a support structure, a base portion and a scissor-lift device disposed between the support structure and the base portion, the scissor-lift device comprising:

a first arm having a first end and a second end, the first end of the first arm hingedly connected to the base portion and the second end of the first arm slidably engaged with the support structure;

a second arm pivotally connected to the first arm via a single pivot connection, the second arm having a first end and a second end, the first end of the second arm slidably engaged with the base portion and the second end of the second arm hingedly connected to the support structure; and wherein the first arm and the second arm are offset from each other to engage with guiding elements disposed on the support structure and the base portion.

12. The apparatus of claim 11 wherein the guiding element of the support structure is disposed on an underside portion thereof to engage with the second end of the first arm and the guiding element of the base portion is disposed thereon to engage with the first end of the second arm.

13. The apparatus of claim 12 wherein the second end of the first arm and the first end of the second arm include a wheel element to facilitate improved sliding engagement with the guiding element on the underside portion of the support structure and the guiding element disposed on the base portion.

14. The apparatus of claim 11 wherein the lifting apparatus further includes an extension device to force one end of the first or second arm upwards to raise the support structure away from the base portion.

15. The apparatus of claim 14 wherein the extension device is a hydraulic cylinder.

16. The apparatus of claim 14 wherein the lifting apparatus includes four scissor-lift devices and four extension devices.

17. The apparatus of claim 12 wherein the support structure includes four separate guiding elements disposed on the underside portion of the support structure and the base portion includes four separate guiding elements disposed thereon.

18. The apparatus of claim 14 wherein the extension device has a first end rotatably attached to the first or second arm of the scissor-lift device and a second end rotatably attached to the base portion.

19. The apparatus of claim 11 wherein the lifting apparatus includes a first centrifuge platform slidably disposed relative to the support structure for supporting a first centrifuge element and a second centrifuge platform slidably disposed relative to the support structure for supporting a second centrifuge element.

20. The apparatus of claim 19 wherein the support structure of the lifting apparatus includes rollers to engage with the first and second centrifuge platforms to facilitate the sliding of the first and second centrifuge platforms away from each other in an operational position and adjacent to one another when in a transportable position.

* * * * *